United States Patent [19]

Plonsker

[11] Patent Number: 4,932,976

[45] Date of Patent: Jun. 12, 1990

[54] TEXTILE LUBRICATION

[75] Inventor: Larry Plonsker, Baton Rouge, La.

[73] Assignee: Ethyl Corporation, Richmond, Va.

[21] Appl. No.: 359,041

[22] Filed: May 30, 1989

[51] Int. Cl.[5] ..... D06M 13/00

[52] U.S. Cl. ..... 8/115.6; 8/581; 8/DIG. 1

[58] Field of Search ..... 252/8.6, 8.8, 115.6; 8/581, DIG. 1, 581; 427/387, 393; 428/266, 391, 447; 556/435, 465, 489

[56] References Cited

U.S. PATENT DOCUMENTS

| | | | |
|---|---|---|---|
| 2,129,281 | 9/1948 | Lincoln et al. | 556/465 |
| 2,544,079 | 3/1951 | Goodwin, Jr. | 556/435 |
| 4,044,033 | 8/1977 | Fusco | 260/410 |
| 4,077,992 | 3/1978 | Fusco | 260/410 |
| 4,541,936 | 9/1985 | Ona et al. | 556/465 |
| 4,746,751 | 5/1988 | Oviatt, Jr. et al. | 556/465 |
| 4,788,312 | 11/1988 | Paciorek et al. | 556/465 |

OTHER PUBLICATIONS

Billica, *Fiber Producer,* Apr. 1984, pp. 21–28.

*Primary Examiner*—Paul Lieberman
*Assistant Examiner*—John F. McNally
*Attorney, Agent, or Firm*—John F. Sieberth

[57] ABSTRACT

In the processing of textile fibers, liquid silahydrocarbons, such as methyltri(decyl)silane, are utilized as textile lubricants. Such lubricants have good high temperature stability.

12 Claims, No Drawings

TEXTILE LUBRICATION

TECHNICAL FIELD

This invention relates to improvements in the art of textile lubrication during processing.

BACKGROUND

The technology involved in textile processing is highly developed and well known to those skilled in the art. In various operations such as hot drawing, texturising, and spin finishing it is customary to employ lubricants in order to suitably reduce friction as between the textile fiber and the surfaces of the processing equipment with which the textile fiber comes in contact. Among the extensive literature on the subject of textile lubrication including lubrication under elevated temperature conditions, reference may be had, for example, to U.S. Pat. Nos. 4,077,992 and 4,044,033, and Billica, *Fiber Producer,* April 1984, pages 21–28 and references cited therein, all disclosures of which patents and literature references are incorporated herein by reference.

THE INVENTION

In accordance with this invention silahydrocarbons are utilized as textile lubricants. Silahydrocarbons suitable for the practice of this invention include compounds having the formula:

$$SiR^1R^2R^3R^4 \quad (I)$$

and compounds having the formula:

$$R^1R^2R^3\text{-Si-}(CH_2)_n\text{-Si-}R^1R^2R^3 \quad (II)$$

wherein the R groups can be alkyl, aryl, aralkyl, alkaryl, cycloalkyl, and can be the same or different, and n is 2 to 8. The total number of carbon atoms in the silahydrocarbon textile lubricants of this invention should be at least sufficient to provide a liquid compound at ambient temperatures, and for a number of applications such as open-end spinning and the like the total number of carbon atoms in the molecule is preferably at least about 30. However for other applications silahydrocarbons with about 24 carbon atoms or more are entirely satisfactory.

Particularly good lubricants for textiles are silahydrocarbons of formula (I) above in which $R^1$ is methyl and each of $R^2$, $R^3$, and $R^4$ is an alkyl group having at least 8 carbon atoms. Another preferred type are the silahydrocabons of formula (I) above in which $R^1$, $R^2$, $R^3$, and $R^4$ is an alkyl group having at least 8 carbon atoms. Methods for the synthesis of such compounds are well known and reported in the literature.

Besides possessing good lubrication properties, the silahydrocarbon textile lubricants of this invention possess the highly desirable characteristic of high temperature stability, for example at temperatures well above 60°–74° C. Indeed the preferred silahydrocarbons utilized pursuant to this invention are those which can be heated as high as 300° C. for three hours without encountering any significant thermal degradation.

A few exemplary silahydrocarbons useful in the practice of this invention include tetrahexylsilane, tetraoctylsilane, tetra(decyl)silane, dibutyldidodecylsilane, ethyltri(decyl)silane, triethylhexadecylsilane, methyltrioctylsilane, methyltri(decyl)-silane, methyltridodecylsilane, tetraphenylsilane, methyltri(p-tolyl)silane, ethyltricyclohexylsilane, tetrabenzylsilane, 1,2-ethanebis(tributylsilane), 1,2-ethanebis(trihexylsilane), 1,4-butanebis(tripropylsilane), 1,4-butanebis(tributylsilane), 1,6-hexanebis(triethyllsilane), 1,6-hexanebis(tributyllsilane), 1,8-octanebis(triethyllsilane), 1,8-octanebis(tripropylsilane), 1,2-ethanebis(triphenylsilane), 1,4-butanebis(tricyclopentylsilane), 1,6-hexanebis(tricyclopropylcarbinylsilane), as well as mixtures of two or more such compounds, such as a mixture of compounds of formula (I) above in which $R^1$ is methyl and $R^2$, $R^3$, and $R^4$ are a mixture of substantially linear octyl and decyl groups. A particularly good textile lubricant is methyltri(decyl)silane.

The textile lubricants of this invention can be applied directly onto the textile fibers by any known method such as by passing the fiber through a bath of the lubricant, by applying the lubricant in the form of a spray, by direct application by means of pads or other wet coating apparatus, etc. Once they have served their purpose as a lubricant, the silahydrocarbons can be easily removed by use of a variety of washing procedures such as immersion in a suitable washing medium, etc.

If desired, the silahydrocarbon textile lubricant may be formulated with other materials, such as extenders or diluents, or other lubricants. For example the silahydrocarbon may be emulsified with water or it may be blended with other high temperature textile lubricants, such as a gem disubstituted cyclic compound in which one radical is a short chain alkyl group and the other radical is a methylene group substituted by an alkyl, alkylene or aryl amido radical or an alkyl, alkylene or aryl carboxylate radical. Such gem disubstituted compounds are described in U S. Pat. Nos. 4,077,992 and 4,044,033. Blends containing from 1 to 99 weight percent silahydrocarbon and from 99 to 1 weight percent gem disubstituted lubricant may be employed.

Any of a wide variety of textile filaments or yarns may be lubricated in the manner of this invention. Thus the silahydrocarbon lubricants may be applied to such textile fibers as polyester fibers, nylon fibers (polyamides), acrylate fibers, rayon fibers, acetate fibers, polyolefin fibers (e.g., polypropylene fibers), and the like.

Inasmuch as this invention is susceptible to considerable variation in its practice it is not intended that it be limited by the foregoing description of preferred embodiments thereof. Rather this invention is to be considered within the spirit and scope of the appended claims.

What is claimed is:

1. In the lubrication of synthetic textile fiber during processing thereof, the improvement which comprises applying to the fiber as a textile lubricant a liquid silahydrocarbon represented by the general formulas:

$$SiR^1R^2R^3R^4$$

or $$R^1R^2R^3\text{—Si—}(CH_2)_n\text{—Si—}R^1R^2R^3$$

wherein each of $R^1$, $R^2$, $R^3$ and $R^4$ independently is alkyl, aryl aralkyl, alkaryl or cycloalkyl, the total number of carbons in the molecule being at least about 24 and n is 2 to 8.

2. The improvement of claim 1 wherein the silahydrocarbon contains at least about 30 carbon atoms in the molecule.

3. The improvement of claim 1 wherein the silahydrocarbon is represented by the general formula:

$$SiR^1R^2R^3R^4$$

wherein each of $R^1$, $R^2$, $R^3$, and $R^4$ is alkyl, aryl, aralkyl, alkaryl, or cycloalkyl, the total number of carbon atoms in the molecule being at least about 24.

4. The improvement of claim 3 wherein $R^1$ is methyl and each of $R^2$, $R^3$, and $R^4$ is a substantially linear alkyl group having at least 8 carbon atoms.

5. The improvement of claim 3 wherein the silahydrocarbon is methyltri(decyl)silane.

6. The improvement of claim 1 wherein the silahydrocarbon 2 is represented by the general formula:

$$R^1R^2R^3\text{-Si-}(CH_2)_n\text{-Si-}R^1R^2R^3$$

wherein each of $R^1$, $R^2$, and $R^3$ is alkyl, aryl, aralkyl, alkaryl, or cycloalkyl, the total number of carbon atoms in the molecule being at least about 24.

7. A synthetic textile fiber having a surface coating of a liquid silahydrocarbon lubricant of claim 1 thereon.

8. The coated fiber of claim 7 wherein the silahydrocarbon contains at least about 30 carbon atoms in the molecule.

9. The coated fiber of claim 7 wherein the silahydrocarbon is represented by the general formula:

$$SiR^1R^2R^3R^4$$

wherein each of $R^1$, $R^2$, $R^3$, and $R^4$ is alkyl, aryl, aralkyl, alkaryl, or cycloalkyl, the total number of carbon atoms in the molecule being at least about 24.

10. The coated fiber of claim 9 wherein $R^1$ is methyl and each of $R^2$, $R^3$, and $R^4$ is a substantially linear alkyl group having at least 8 carbon atoms.

11. The coated fiber of claim 9 wherein the silahydrocarbon is methyltri(decyl)silane.

12. The coated fiber of claim 7 wherein the silahydrocarbon is represented by the general formula:

$$R^1R^2R^3\text{-Si-}(CH_2)_n\text{-Si-}R^1R^2R^3$$

wherein each of $R^1$, $R^2$, and $R^3$ is alkyl, aryl, aralkyl, alkaryl, or cycloalkyl, the total number of carbon atoms in the molecule being at least about 24.

* * * * *